United States Patent [19]

Reimer et al.

[11] Patent Number: 4,717,635

[45] Date of Patent: Jan. 5, 1988

[54] ELECTROPHOTOGRAPHIC RECORDING MATERIAL

[75] Inventors: Bernd Reimer, Warstein-Belecke; Hans-Hermann Beschoner, Erwitte; Manfred Lutz, Warstein-Belecke, all of Fed. Rep. of Germany

[73] Assignee: Licentia Patent-Verwaltungs-GmbH, Frankfurt am Main, Fed. Rep. of Germany

[21] Appl. No.: 863,988

[22] Filed: May 16, 1986

[30] Foreign Application Priority Data

May 25, 1985 [DE] Fed. Rep. of Germany ..... 3518999

[51] Int. Cl.[4] ..... G03G 5/08

[52] U.S. Cl. ..... 430/57; 430/86; 430/95

[58] Field of Search ..... 430/59, 62, 63, 66, 430/84, 57, 86, 95

[56] References Cited

U.S. PATENT DOCUMENTS 3,655,377 4/1972 Sechak ..... 430/86
4,121,981 10/1978 Ward et al. ..... 430/85
4,613,557 9/1986 Foley et al. ..... 430/84

FOREIGN PATENT DOCUMENTS 1597882 3/1970 Fed. Rep. of Germany .
2723925 5/1977 Fed. Rep. of Germany .
2122365 1/1984 United Kingdom .

*Primary Examiner*—John L. Goodrow
*Attorney, Agent, or Firm*—Spencer & Frank

[57] ABSTRACT

An electrophotographic recording material, composed of an electrically conductive substrate; a first layer provided on the electrically conductive substrate and composed of an amorphous selenium-tellurium alloy containing form 0.05 to 15 weight % tellurium; a second layer disposed on the first layer and composed of an amorphous selenium-tellurium alloy containing from 15 to 60 weight % tellurium; and a third layer provided on the second layer and composed of an amorphous alloy of selenium and from 0.05 to 5 weight % of one arsenic or tellurium. The electrophotographic recording material is particularly useful in an electrophotographic recording system which includes an infrared radiation means, such as an infrared solid state laser.

21 Claims, 1 Drawing Figure

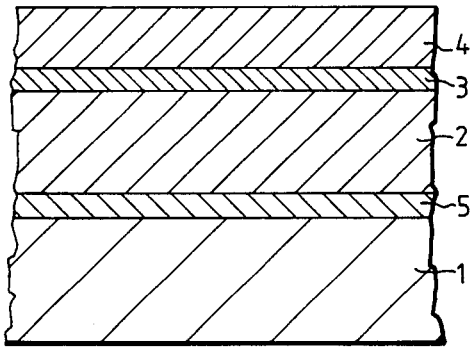
4
3
2
5
1

ELECTROPHOTOGRAPHIC RECORDING MATERIAL

BACKGROUND OF THE INVENTION

1. Field of the Invention

The present invention relates to an electrophotographic recording material composed of an electrically conductive substrate onto which three selenium-containing layers are consequently applied.

2. Background of the Art

Electrophotographic recording materials include photoconductive materials and are employed in photocopying processes which are essentially based on the fact that the photoconductive materials employed change their electrical resistance when irradiated with actinic light, i.e., activating radiation. For many applications, the electrophotographic recording material is composed simply of a single photoconductive layer applied to an electrically conductive substrate. In the unexposed state, the photoconductor has a relatively high dark resistance and can therefore be electrically charged. Upon exposure to actinic light, the charge is dissipated in the exposed locations and, ideally, the residual potential is zero. When exposure to actinic light is a pattern-wise exposure achieved, for example, by projecting an optical image onto the charged photoconductor, a latent, electrically charged image remains which corresponds to the dark areas of the optical image. This latent image is then developed by any of several known methods, such as by means of contact with a particulate toner material, and the developed image is transferred to paper.

An electrophotographic recording material and the photoconductor employed therein must meet the requirements that the dark resistance of the photoconductor be very high, while after exposure, the residual potential be as low as possible. It is also frequently desirable for the electrophotographic recording material to exhibit panchromatic behavior, i.e., to be sensitive to activating radiation spanning at least the entire visible spectral range. For some applications, it is preferable that the panchromatic behavior be extended to include the infrared (IR) spectral range, out to, for example, 900 nm. Recording material having such an IR-extended panchromatic response can be activated by the radiation from an IR solid state laser as employed, for example, in data output devices. In addition to the above-mentioned characteristics, the recording material must also have, inter alia, good thermal stability and exhibit little charge/discharge fatigue on recycling.

To satisfy as many of the above requirements as possible and to simultaneously provide the generally directly proportional properties of high dark resistance and low residual potential, single-layered photoconductive materials have been replaced by multi-layered photoconductive materials. Recording materials employing three photoconductive layers, on which the present invention is based, are disclosed in, for example, German Laid-open Patent Application No. 2,615,624 and German Patent No. 1,597,882, the disclosures of which are herein incorporated by reference. The first layer adjacent the substrate functions as a charge carrier transporting layer since, upon exposure, it is constituted so as to facilitate the movement of exposure-generated charge carriers from the center layer to the substrate. The center, or second layer, is constituted so as to function as a charge carrier generating layer since charge carriers are produced in it upon exposure to activating radiation. It is these charge carriers which are responsible for transporting electrostatic charge from the exposed location through the photoconductor to the substrate, which substrate is maintained at a lower potential, such as ground potential. Finally, the third layer generally is constituted so as to function primarily as a protective layer which is provided, inner alia, to improve the mechanical characteristics of the recording material, such as to improve wear resistance.

In German Patent No. 1,597,882, the first layer is composed of an amorphous selenium-arsenic alloy; the second layer, an amorphous selenium-tellurium alloy; and the third layer, an amorphous selenium-arsenic alloy. This triple-layer arrangement provides a panchromatically-sensitive recording material, which is thermally- and humidity-stable and which exhibits only slight evidence of charge/discharge fatigue on recycling. This prior art recording material, however, has a relatively high residual potential and has a fatigue characteristic upon cycling, i.e., a reduced charge acceptance and/or a reduced contrast potential upon charge/discharge recycling, which is still excessive for many applications.

SUMMARY OF THE INVENTION

It is an object of the present invention to make available a triple-layered, electrophotographic recording material which has an IR-extended, panchromatic response, only a very slight residual potential, and exhibits practically no cycling fatigue.

A further object of the present invention is to provide an electrophotographic recording system having an infrared radiation means and an electrophotographic recording material which is responsive to the infrared radiation means, has only a very slight residual potential, and exhibits practically no cycling fatigue.

The present invention accomplishes these objects by providing an electrophotographic recording material which includes an electrically conductive substrate; a first layer provided on the electrically conductive substrate and comprised of an amorphous selenium-tellurium alloy containing from 0.05 to 15% weight % telurium; a second layer disposed on the first layer and comprised of an amorphous selenium-tellurium alloy containing from 15 to 60 weight % tellurium; and a third layer provided on the second layer and comprised of an amorphous alloy of selenium and from 0.5 to 5 weight % of arsenic or tellurium. This electrophotographic recording material is responsive to an infrared radiation means and an electrophotographic recording system may include an infrared radiation means, such as an infrared solid state laser, and the recited electrophotographic recording material.

One or more of the layers may contain from a finite amount to 200 ppm halogen. When the first layer contains from 0.5 to 3 weight % tellurium, it advantageously contains from a finite amount to 20 ppm halogen. When the second layer contains from 25 to 50 weight % tellurium, it may advantageously contain from a finite amount to 20 ppm halogen, in order to reduce residual potential without increasing fatiguing effects.

The third layer, a protective layer, may advantageously be comprised of an amorphous selenium-arsenic alloy containing from 0.05 to 5 weight % arsenic. Preferably, the third layer contains from 0.2 to 1 weight % arsenic and advantageously from a finte amount of 90 ppm halogen. Most preferably, the third layer has a free surface along the side thereof opposite the second layer and has an arsenic concentration gradient which increases toward the free surface and reaches a maximum of 15 weight % at the free surface.

Alternately, the third layer may be comprised of an amorphous selenium-tellurium alloy containing from 0.05 to 5 weight % tellurium. Preferably the third layer contains from 0.2 to 5 weight % tellurium, and advantageously, contains from a finite amount to 200 ppm halogen. Most preferably, the third layer contains from 0.2 to 3 weight % tellurium, and advantageously contains from a finite amount to 20 ppm halogen.

The triple-layered photoconductor of the electrophotographic recording material according to the present invention preferably has a first layer having a thickness ranging from 10 to 100 microns, most preferably from 40 to 80 microns. The second layer preferably has a thickness ranging from 0.1 to 1 micron, most preferably from 0.2 to 0.4 micron. The third layer preferably has a thickness ranging from 0.5 to 10 microns, most preferably from 1 to 5 microns.

The electrophotographic recording material according to the present invention may further comprise an intermediate layer disposed between the electrically conductive substrate and the first layer for absorbing at least 90 percent of radiation transmitted thereto in the wavelength range of from 600 to 900 nm. Preferably, the intermediate layer is comprised of one or more elements from among cadmium, gallium, indium, thallium, antimony, phosphorus, tellurium and manganese. Instead of, or in addition to, the intermediate layer, the electrically conductive substrate may be roughened along the surface thereof unto which the first layer is provided, preferably to a roughening depth ranging from 0.1 to 5 microns.

The electrophotographic recording material according to the invention has only a very slight residual potential which does not change even after prolonged cyclic operation, and can therefore be used successfully in electrophotographic systems employing monocomponent development, i.e., development is performed on a system having one electrophotographic recording material component, as well as dual-component systems. The majority of prior art recording materials are not usable in systems employing monocomponent development, because they do not meet the performance characteristics previously discussed. Further, the recording material according to the invention exhibits an extremely low level of charge/discharge fatigue. After cyclical operation of the recording material over several days in a non-impact printer, no decrease in charge acceptance and no increase in residual potential were observed. Excellent print quality, even in continuous operation, is thus assured. Excellent print quality is also realized when an alternating voltage corotron, i.e., an AC corona charging device, is employed as a quenching device. Finally, the recording material is mechanically hard, thermally stable, and has high sensitivity in the infrared spectral range.

BRIEF DESCRIPTION OF THE DRAWING

The invention may be better understood by referring to the detailed description of the invention when taken in conjunction with the sole drawing FIGURE in which the structure of the inventive electrophotographic recording material is shown schematically.

DETAILED DESCRIPTION OF THE INVENTION

With reference to the FIGURE, on an electrically conductive substrate 1, a first layer 2 of a triple-layered photoconductor is disposed. The first layer 2 functions as a charge carrier transporting layer. A second layer 3, which functions in the photoconductor as a charge carrier generating layer, is disposed on the first layer 2. Finally, a third layer 4, which functions as a protective cover layer is disposed on the second layer 3.

For some applications, an intermediate layer 5 may be provided between the electrically conductive substrate 1 and the first layer 2. This intermediate layer serves as an anti-reflection layer by substantially absorbing the portion of the irradiating light not adsorbed within the photoconductor and along the beam path, which otherwise could be reflected by substrate 1 back through the triple-layered photoconductor and reduce the contrast potential and/or produce interference patterns. Intermediate layer 5 is advantageously employed when actinic radiation in a wavelength range of from 600 to 900 nm, is used to irradiate the charged recording material, most particularly if an infrared laser producing collimated light is used. An absorption of at least 90% is desired and is obtained when, for example, one or more elements, such as cadmium, gallium, indium, tellurium, antimony, phosphorus, tellurium and manganese is used in an appropriate thickness as the intermediate layer 5.

The anti-reflection effect can alternately be realized by roughening the surface of substrate 1 onto which the first layer 2 is subsequently provided. A roughening depth ranging from 0.1 to 5 microns is advantageous and may be achieved by any appropriate means, such as etching, or mechanical processes. The roughening causes the irradiating light that is not absorbed in the triple-layered photoconductor along the beam path to be scattered, i.e., diffused, thereby preventing direct reflection and the attendant possibility of the generation of optical interference patterns.

The intermediate layer 5 or the roughened substrate 1 both prevent direct reflection of the irradiating light at the surface of substrate 1 by, respectively, absorption thereof and scattering thereof. Thus, it is also possible to eliminate annoying interference structures in the printed image (ghost images), which can result from the generation of optical interference patterns, i.e., constructive/destructive standing wave patterns, in the photoconductor. Optical interference occurs between the irradiating light and the reflected light, and is a particular problem if collimated laser radiation having a very narrow bandwidth is employed.

The electrophotographic recording material is produced according to known and conventional methods. However, the procedures will be described with the aid of the two Examples listed below.

EXAMPLE 1

Three selenium-containing photoconductive layers were successively applied to an electrically conductive substrate composed of aluminum in a vapor deposition process. Vacuum evaporation took place at a pressure of $10^{-4}$ mbar and at a substrate temperature of about 70° C. The first layer was vapor-deposited from a first evaporator containing the material being evaporated, in this case, the material being composed of an alloy of selenium and 0.5 weight % tellurium having 20 ppm chlorine. The evaporation temperature was 330° C. to 340°

C. The material was weighed into the first evaporator in a quantity for which full evaporation produced a layer thickness of about 60 microns. Tellurium gradients appearing at the end of the evaporation process were avoided by a timely closure of an aperture provided between the evaporator and the substrate.

Thereafter, an alloy of selenium and 50 weight % tellurium was vapor-deposited onto the first layer from a second evaporator, at an elevation temperature of about 350° C. to 360° C. Vacuum evaporation of the second layer continued until a thickness of about 0.2 microns was reached. Then, from a third evaporator, an alloy of selenium and 0.5 weight % arsenic was vapor-deposited onto the second layer at a temperature between 320° C. and 330° C. The material was weighed into the third evaporator in an amount for which full evaportion produced a protective cover layer having a thickness of 3 microns.

The thus-obtained electrophotographic recording material has a high sensitivity in the infrared wavelength range out to about 900 nm. When charged to a potential of +800 V and irradiated with light having a wavelength of 800 nm and an illumination intensity of 1 $\mu J/cm^2$, a contrast potential of about 400 V was realized. The residual potential during the first cycle was 5 V. Even after cyclical operation over several hours through more than $10^4$ cycles, no increase in residual potential was observed. Moreover, charge acceptance and contrast potential remained substantially constant.

EXAMPLE 2

First and second layers were deposited as in Example 1. The third layer of selenium containing 0.5 weight % arsenic was vapor-deposited from the third evaporator at an evaporation temperature of about 280° C. so that an arsenic concentration gradient develops which increases toward the free surface. The increased arsenic concentration at the outermost surface of the triple-layered photoconductor results in an increased cross-linking of the selenium and, thus, in an increased mechanical stability of the photoconductor.

The recording material thus obtained likewise has high infrared sensitivity out to about 900 nm. When charged to a potential of +800 V and irradiated with light having an illumination intensity of $\mu^J/cm^2$, a contrast potential of about 400 V was realized for light having a wavelength of 800 nm. The residual potential was about 10 V and did not change even after several hours of cyclical operation.

It will be understood that the above description of the present invention is susceptible to various modifications, changes and adaptations, and the same are intended to be comprehended within the meaning and range of equivalents of the appended claims.

What is claimed is:

1. Electrophotographic recording material, comprising:

an electrically conductive substrate;

a first layer provided on the electrically conductive substrate and comprised of an amorphous selenium-tellurium alloy containing from 0.05 to 15 weight % tellurium;

a second layer disposed on the first layer and comprised of an amorphous selenium-tellurium alloy containing from 15 to 60 weight % tellurium; and a third layer provided on the second layer and comprised of an amorphous alloy of selenium and from 0.05 to 5 weight % of one of arsenic and tellurium.

2. The electrophotographic recording material as defined in claim 1, wherein one or more of the layers contains from a finite amount to 200 ppm halogen.

3. The electrophotographic recording material as defined in claim 1, wherein the first layer contains from 0.5 to 3 weight % tellurium.

4. The electrophotographic recording material as defined in claim 3, wherein the first layer contains from 1 to 20 ppm halogen.

5. The electrophotographic recording material as defined in claim 1, wherein the second layer contains from 25 to 50 weight % tellurium.

6. The electrophotographic recording material as defined in claim 5, wherein the second layer contains from a finite amount to 20 ppm halogen.

7. The electrophotographic recording material as defined in claim 1, wherein the third layer is comprised of an amorphous selenium-arsenic alloy containing from 0.05 to 5 weight % arsenic.

8. The electrophotographic recording material as defined in claim 7, wherein the third layer contains from 0.2 to 1 weight % arsenic.

9. The electrophotographic recording material as defined in claim 8, wherein the third layer contains from a finite amount to 90 ppm halogen.

10. The electrophotographic recording material as defined in claim 7, wherein the third layer has a free surface along the side thereof opposite the second layer, and has an arsenic concentration gradient which increases toward the free surface and reaches a maximum of 15 weight % arsenic at the free surface.

11. The electrophotographic recording material as defined in claim 1, wherein the third layer is comprised of an amorphous selenium-tellurium alloy containing from 0.05 to 5 weight % tellurium.

12. The electrophotographic recording material as defined in claim 11, wherein the third layer contains from 0.2 to 5 weight % tellurium.

13. The electrophotographic recording material as defined in claim 12, wherein the third layer contains from a finite amount to 20 ppm halogen.

14. The electrophotographic recording material as defined in claim 11, wherein the third layer contains from 0.2 to 3 weight % tellurium.

15. The electrophotographic recording material as defined in claim 14, wherein the third layer contains from a finite amount to 20 ppm halogen.

16. The electrophotographic recording material as defined in claim 1, wherein the first layer has a thickness ranging from 10 to 100 microns, the second layer has a thickness ranging from 0.1 to 1 micron, and the third layer has a thickness ranging from 0.5 to 10 microns.

17. The electrophotographic recording material as defined in claim 1, wherein the first layer has a thickness ranging from 40 to 80 microns, the second layer has a thickness ranging from 0.2 to 0.4 micron, and the third layer has a thickness ranging from 1 to 5 microns.

18. The electrophotographic recording material as defined in claim 1, further comprising an intermediate layer disposed between the electrically conductive substrate and the first layer for absorbing at least 90% of radiation transmitted thereto in the wavelength range of from 600 to 900 nm.

19. The electrophotographic recording material as defined in claim 18, wherein the intermediate layer is comprised of one or more element selected from the group consisting of cadmium, gallium, indium, thallium, antimony, phosphorus, tellurium and manganese.

20. The electrophotographic recording material as defined in claim 1, wherein the electrically conductive substrate is roughened along the surface thereof onto which the first layer is provided to a roughening depth ranging from 0.1 to 5 microns.

21. An electrophotographic recording system, comprising:

infrared radiation means; and an electrophotographic recording material according to claim 1, responsive to said infrared radiation means.

* * * * *